United States Patent [19]

Cotter et al.

[11] Patent Number: 5,033,074

[45] Date of Patent: Jul. 16, 1991

[54] X-RAY COLLLIMATOR FOR ELIMINATING THE SECONDARY RADIATION AND SHADOW ANOMALY FROM MICROFOCUS PROJECTION RADIOGRAPHS

[75] Inventors: Daniel J. Cotter, N. Easton; William D. Koenigsberg, Concord, both of Mass.

[73] Assignee: GTE Laboratories Incorporated, Waltham, Mass.

[21] Appl. No.: 445,218

[22] Filed: Dec. 4, 1989

[51] Int. Cl.[5] ..... G21K 1/02

[52] U.S. Cl. ..... 378/147; 378/140

[58] Field of Search ..... 378/147, 126, 145, 89, 378/140, 84

[56] References Cited

U.S. PATENT DOCUMENTS

| | | | |
|---|---|---|---|
| 3,102,957 | 9/1963 | Slauson | 250/105 |
| 3,134,903 | 5/1964 | Fengler | 250/105 |
| 3,227,880 | 1/1966 | Wideröe | 250/105 |
| 3,324,294 | 6/1967 | McGrath, Jr. | 250/105 |
| 3,781,564 | 12/1973 | Lundberg | 250/505 |
| 3,864,576 | 2/1975 | Stevenson | 250/505 |
| 3,920,999 | 11/1975 | Drexler et al. | 250/493 |
| 3,936,647 | 2/1976 | Fekete | 378/153 |
| 4,145,616 | 3/1979 | Tanabe | 250/505 |
| 4,196,367 | 4/1980 | Diemer et al. | 313/59 |
| 4,327,293 | 4/1982 | Taumann | 378/147 |
| 4,388,728 | 6/1983 | Emmanuel | 378/34 |
| 4,472,827 | 9/1984 | Gabbay et al. | 378/140 |
| 4,727,562 | 2/1988 | Belanger | 378/99 |

*Primary Examiner*—Edward P. Westin
*Assistant Examiner*—Kim-Kwok Chu
*Attorney, Agent, or Firm*—Frances P. Craig

[57] ABSTRACT

A new and improved microfocus radiography system incorporating a novel x-ray collimating device for eliminating shadow anomalies caused by secondary radiation from materials within the path of x-rays emitting from an x-ray source. The improved system includes a body defining an opening through which primary radiation may pass from a focal spot x-ray source toward a sample, an x-ray window covering the distal end of the opening, x-ray detection means, and an internal collimator to suppress secondary radiation. The window is penetrable by primary radiation passing through the opening with negligible generation of secondary radiation. The collimator defines an aperture and is disposed along the path of the radiation between said focal spot and said window so as to attenuate any passing primary radiation not directly striking the x-ray window. The collimator is formed from a material having a low vapor pressure at temperatures and pressures at which the system is operated. Portions of said collimator exposed to the passing primary radiation are formed from a material selected to attenuate any passing primary radiation not directly striking the x-ray window, and which generates negligible secondary radiation on exposure to said primary radiation.

12 Claims, 3 Drawing Sheets

X-RAY COLLLIMATOR FOR ELIMINATING THE SECONDARY RADIATION AND SHADOW ANOMALY FROM MICROFOCUS PROJECTION RADIOGRAPHS

BACKGROUND OF THE INVENTION

This invention relates to apparatus for nondestructive evaluation of materials, and in particular to an x-ray collimating device useful in microfocus projection radiography.

Microfocus projection radiography is an emerging technology used to nondestructively evaluate materials and components. A unique feature of the microfocus system is its small x-ray focal spot, nominally 10 μm in diameter, which allows high magnification projection imaging without significant loss of geometric sharpness. Magnification is essential for detection of small defects, e.g., those less than 100 μm in size.

Conventional radiography, which in general does not allow magnification without loss of geometric sharpness, can introduce imaging anomalies or artifacts. In conventional radiography, these anomalies or artifacts are well understood. However, recent proliferation of microfocus x-ray systems has revealed imaging artifacts peculiar to microfocus projection radiography.

One type of imaging artifact that has been observed with microfocus radiography has become known as the "shadow problem". This term refers to an unexpected increase in radiographic density (excess film darkening) on the x-ray film image of an object. This anomaly occurs with magnifications significantly greater than 1×, i.e., where the object exposed to radiation is sufficiently distant from the film surface to result in magnification, for reasons described in more detail below. The extent of the shadow increases as the object is moved laterally farther from the centerline connecting the x-ray source and the center of the image plane. The shadow is particularly apparent when film imaging is performed with low accelerating potentials (kilovoltages) where x-ray attenuation is high. The shadow follows the edge contour of the object being radiographed; for example, the shadow on a bar with a straight edge appears straight while the shadow on a bar with a contoured edge traces the contour. Depending on the image geometry, a second shadow can sometimes be observed that is much less significant.

An illustration of two contiguous bars radiographed side-by-side but off the centerline of the x-ray source and image plane is shown in FIG. 1. In FIG. 1, source focal spot 1 emits x-rays 2, some of which are directed toward object 3 comprising bars 4 and 5 disposed between focal spot 1 and film 6. Magnified image 3*a* of object 3 is produced on film 6 showing images 4*a* and 5*a* of bars 4 and 5 respectively. The degree of magnification of images 4*a* and 5*a* depends on the relative distance between film 6 and object 3 and between object 3 and focal spot 1. First shadow 7 (darker) and an apparent second shadow 8 (less dark) also appear on the film as a darkening of a portion of the image. Apparent second shadow 8 overlaps an observable line between images 4*a* and 5*a* indicating the interface between bars 4 and 5. First shadow 7 typically includes an overlapping portion from an actual second shadow of which the non-overlapping portion appears as shadow 8. The overlapping portion of the actual second shadow may or may not coincide with the entirety of first shadow 7. However, an outer edge of the actual second shadow occurring within the borders of first shadow 7 will not normally be apparent due to the typically greater radiographic density of first shadow 7. Since bars 4 and 5 have straight edges, the edges of shadows 7 and 8 also appear as straight. The shadow effect is observable in all dimensions of the image, proportional to the dimensions of the object. However, for the purpose of illustration, only the most prominent shadow, that of the width dimension, is shown in FIG. 1.

Detection of flaws in materials and components by microfocus projection radiography is dependent on a change in image contrast, caused by some minimal change in object thickness, density, or composition, that is detectable on the radiograph. A flaw such as a crack or a void is imaged as a local increase in radiographic density (darkening) on the radiograph caused by an effective decrease in object thickness at the crack or flaw. The shadow anomaly not only obscures local radiographic density changes but also reduces the overall signal-to-noise ratio of the image. The shadow also, for the same reasons, makes it difficult to define the true edge of the object on the image. This characteristic is critical because knowledge of the proximity of a flaw to the edge of the object is a key factor in determining the severity of the flaw. Thus, suppression or elimination of the shadow anomaly is essential for optimizing the nondestructive evaluation process utilizing microfocus projection radiography.

A certain degree of darkening is typically observed at the edge of the magnified image, due to geometric effects dependent on such factors as object shape and degree of magnification. FIG. 2, in which like features to those in FIG. 1 are designated by the same reference numerals, illustrates the definition of the true edge 9 of object 10 comprising two contiguous bars 11 and 12 positioned side to side. Divergent x-rays 2 from source focal spot 1 are directed as primary radiation toward edge 9 of object 10. The rays travel shorter path lengths within the object, as 13 and 14, through the outer edges of the body, but the path lengths, as 15 and 16, through the main body are nearly constant. A small change in thickness, e.g. that caused by a void or a crack, has a large effect on attenuation at the edge of the body, as between path lengths 13 and 14, showing as a darker area in the image, while the attenuation associated with the main body is nearly constant. This expected geometric effect on the image generated by the primary radiation, however, does not explain the shadow anomaly observed in the film image.

In the course of development of the present invention, the major source of the shadow anomaly in microfocus projection radiography has been identified, and a device has been developed for suppressing the shadow anomaly. The device substantially reduces the severity of image artifacts (shadows) observed in projection radiographs, and improves flaw detection sensitivity for nondestructive evaluation of materials and components.

SUMMARY OF THE INVENTION

An improved microfocus projection radiography system, in accordance with one aspect of the invention, includes a body defining an opening through which primary radiation may pass from a focal spot x-ray source toward a sample. The passing primary radiation generally defines a path having a centerline, and the opening has a near end and a distal end relative to the x-ray source. A window covering the opening at its distal end is penetrable by the passing primary radiation with negligible generation of secondary radiation. X-ray detection means is disposed in the path beyond the sample and generally normal to the centerline so that portions of the passing primary radiation reach both the sample and the detection means to form a projected x-ray image of the sample at the detection means. The sample is spaced from the window and from the detection means to permit magnification of the image. A collimator defining an aperture is disposed along the path between said focal spot and said window so as to attenuate any of the passing primary radiation not directly striking the window. The collimator is formed from a material having a low vapor pressure at temperatures and pressures at which the system is operated. The portions of the collimator exposed to the passing primary radiation are formed from a material selected to attenuate any of the passing primary radiation not directly striking the window and which generates negligible secondary radiation on exposure to the primary radiation.

An x-ray collimating device, in accordance with another aspect of the invention, is intended for use in a microfocus projection radiography system to eliminate shadow anomalies caused by secondary radiation generated upon exposure to primary radiation of materials along a path of said primary radiation. The microfocus projection radiography system includes a body defining an opening through which the primary radiation may pass from a focal spot x-ray source toward a sample along the path, which has a centerline. The opening has a near end and a distal end relative to the x-ray source. A window covering the opening at the distal end is penetrable by the passing primary radiation with negligible generation of secondary radiation. X-ray detection means is disposed in the path beyond the sample and generally normal to the centerline so that portions of the passing primary radiation reach both the sample and the detection means to form a projected x-ray image of the sample at the detection means. The sample is spaced from the window and from the detection means to permit geometric magnification of the image. The collimating device, in accordance with this aspect of the invention, includes a collimator defining an aperture and positionable along the path between said focal spot and said window so as to attenuate any of the passing primary radiation not directly striking the window. The collimator is formed from a material having a low vapor pressure at temperatures and pressures at which the system is operated. Portions of the collimator exposed in use to the passing primary radiation are formed from a material selected to attenuate any of the passing primary radiation not directly striking the window, and which generates negligible secondary radiation on exposure to the primary radiation.

BRIEF DESCRIPTION OF THE DRAWING

For a better understanding of the present invention, together with other objects, advantages and capabilities thereof, reference is made to the following Description and appended Claims, together with the Drawing, in which:

DETAILED DESCRIPTION OF THE PREFERRED EMBODIMENT

Figure 1:
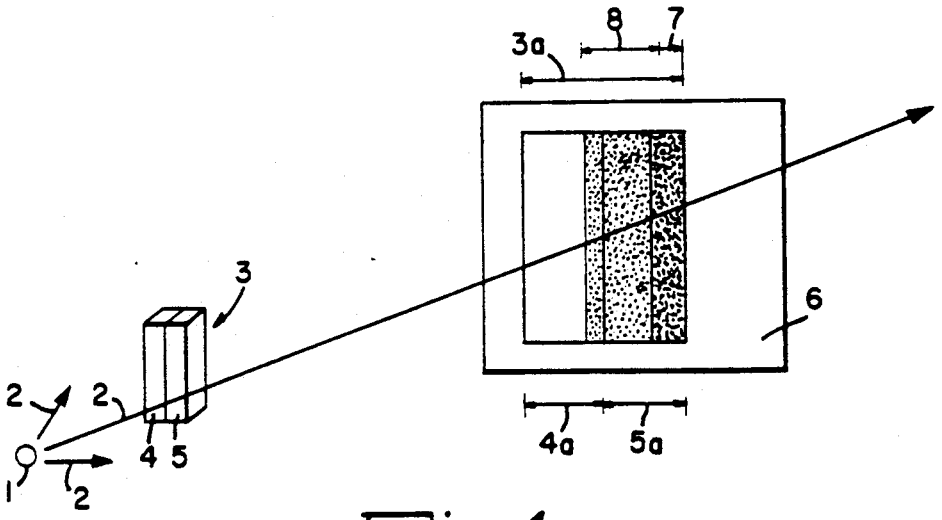
FIG. 1 is a schematic representation of the shadow anomaly problem to which the present invention is addressed.
Figure 2:
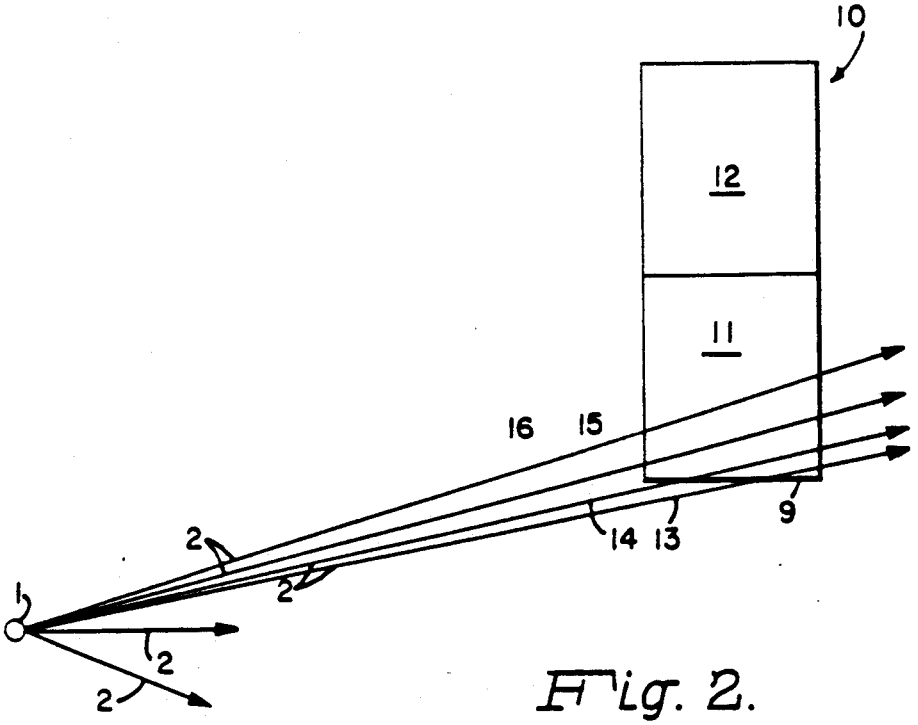
FIG. 2 is a schematic representation of the geometric attenuation effect encountered in microfocus projection radiography.

It has recently been discovered, in the course of development of the present invention, that there is a source of significant secondary radiation found in known microfocus projection radiography apparatus which is sufficient to account for the observed shadow anomaly. The source of this secondary radiation is shown in FIG. 3, in which like features to those in FIGS. 1 and 2 are designated by the same reference numerals.

Figure 3:
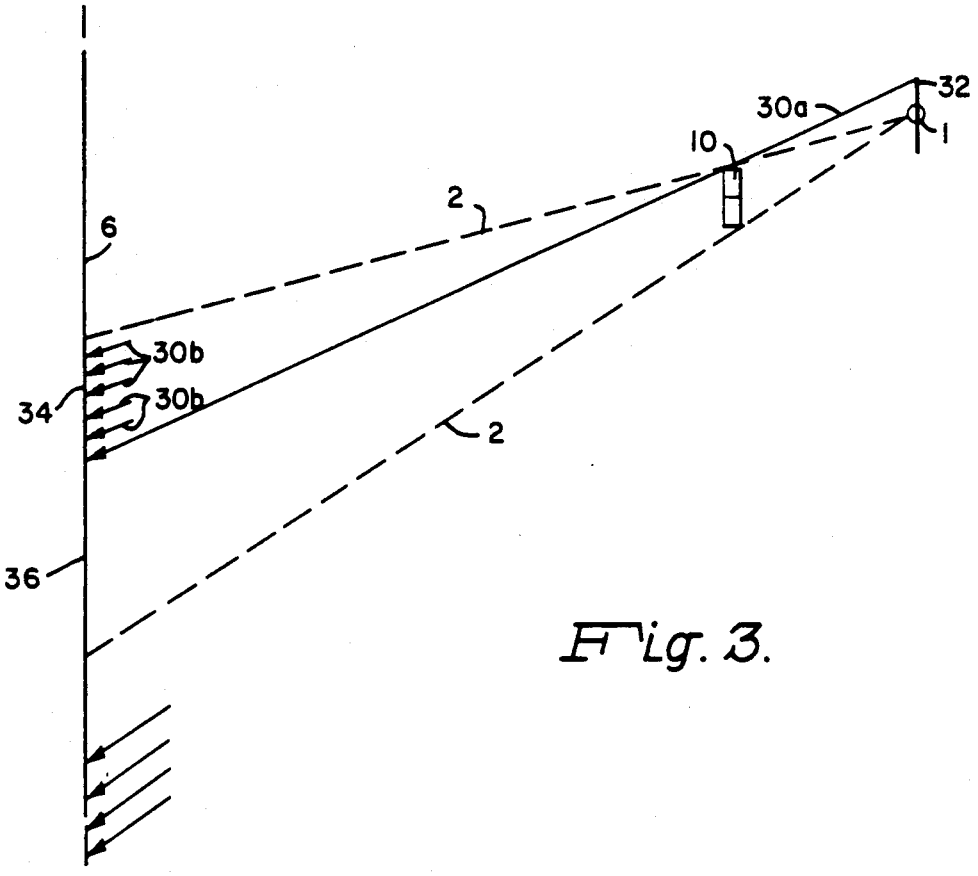
FIG. 3 is a schematic representation of the newly discovered principal source of the shadow anomaly, i.e. secondary radiation which is homogeneously emitted re-radiation and/or scatter from the primary radiation.

In FIG. 3, article 10 is disposed between focal point 1 and film 6 at a position relative to each selected to produce the desired degree of magnification. Primary radiation 2 directed toward article 10 produces a magnified image on film 6, shown as two regions, 34 and 36. Secondary radiation, as 30*a* and 30*b*, is produced when primary radiation 2 from x-ray focal spot 1 penetrates the tube head housing (typically fabricated of brass), not shown, and the window housing (typically of aluminum), not shown, and is re-radiated (as fluorescent radiation) and/or scattered, generating the secondary radiation. Some of the secondary radiation is directed toward object 10 from points, as 32, separated from primary focal spot 1.

Some of the secondary radiation, as 30*b*, reaches film 6, independently of the primary radiation causing darkening of the film (out of focus fog), except where article 10 prevents the secondary radiation from reaching the film. This is analogous to a shadow cast by the object. The secondary source darkening at region 34 overlaps the image from primary radiation 2 and causes a shadow to appear at the edge of the image similar to that shown as shadow 7 in FIG. 1. The secondary source darkening is readily observed only where it is superimposed on the intended projection image of article 10 produced by the primary beam. Elsewhere on film 6 the darkening from primary radiation 2 is too intense for the additional darkening from the secondary radiation to be noticeable. Secondary radiation 2 is blocked by article 10 from reaching film 6 at region 36 of the image. Thus, the image in region 36 exhibits no shadow.

Several factors contribute to the observation of the shadow anomaly, including the imaging geometry of the microfocus projection radiography system, the degree of magnification, the size and material composition of the object, the size and intensity of the secondary source, and operation of the apparatus at low accelerating potentials where the second source has a significant contribution. However, it is important to realize that the secondary radiation is always present, even when the shadow anomaly is not readily observable, and can significantly degrade the signal-to-noise ratio, which is the major limiting factor in flaw detection sensitivity (the ability to distinguish local inhomogeneities from the background image). For example, placing the object to be imaged on the centerline between the x-ray source and the film will minimize the shadow observed, but the secondary radiation still causes darkening of the film and reduces image contrast. Similarly, the shadow anomaly is not apparent in the imaging of large complex-shaped objects, but the secondary radiation still compromises the signal-to-noise ratio, reducing image contrast.

Thus, it was determined tat suppression of the source of secondary radiation was essential to achieving the required flaw detection sensitivity for nondestructive evaluation using microfocus projection radiography. Such suppression has been achieved by the use of a collimating device according to the invention, for example by its addition to known microfocus projection radiography apparatus. The steps leading to the discovery of the cause of the shadow anomaly, and to the solution to the problem, are described in further detail below.

Figure 4:
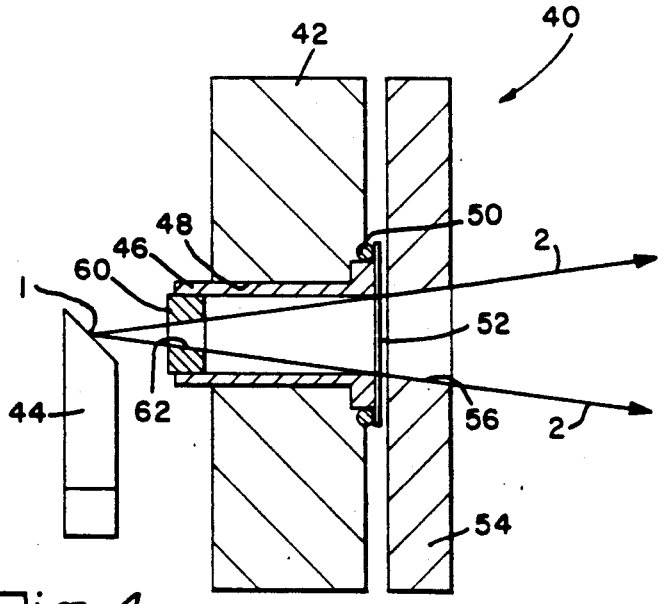
FIG. 4 is a cross sectional view of a portion of a microfocus x-ray system with an internal collimator installed in accordance with one embodiment of the present invention.

Shown in FIG. 4 is a cross sectional view of anode assembly 40 of a typical microfocus x-ray system, for example model HOMX 161A, manufactured by IRT Corporation, San Diego, Calif. Anode assembly 40 includes tube head or anode body 42 with anode target 44 container therein. Entire assembly 40 is enclosed by means not shown and a vacuum environment, typically about $1.2\times10^{-6}$ Torr, is maintained therein. Aluminum bushing 46 is positioned within opening 48 in anode body 42 to hold window O-ring 50 in place. Beryllium window 52 is disposed against window O-ring 50 and aluminum bushing 46, and is held in place by a window cap (not shown) and by the external pressure exerted against beryllium window 52 due to the internal vacuum environment.

X-rays which are emitted from anode target 44 upon bombardment from a directed electron beam and which enter opening 48 of anode body 42 define a radiation path through the opening and toward the sample and the film. The x-rays are directed, in typical prior art apparatus, both toward aluminum bushing 46 and through beryllium window 52. The term "path" or "radiation path", as used herein and in the accompanying claims, is intended to mean the region in space through which the primary radiation from focal point 1 passes through opening 48 toward the sample and toward the imaging means. In such prior art apparatus an external collimator, as external collimator 54 in FIG. 4, typically is provided to attenuate extraneous radiation outside of a diameter slightly less than that of the window opening. Thus, only radiation passing through aperture 56 of external collimator 54 reaches the sample. A portion of the rays passing through aperture 56 are then absorbed by the sample, shown as article 10 in FIGS. 2 and 3, the remaining transmitted portion exposing the x-ray film, shown as film 6 in FIGS. 1–3.

In such prior art apparatus, x-rays striking aluminum bushing 46 are re-radiated and/or scattered, forming secondary sources of radiation, shown as secondary radiation 30*a* and 30*b* in FIG. 3. External collimator 54, as described in more detail below, is not sufficient to eliminate all of the secondary radiation. Thus some secondary radiation passes through aperture 56, causing the shadow anomaly, as illustrated in FIGS. 1 and 3.

Also shown in FIG. 4 is internal collimator 60 installed within aluminum bushing 46 between anode target 44 and beryllium window 52. As used herein and in the accompanying claims, the term "internal collimator" is intended to mean a collimator positioned within the anode body, as body 40, between the focal point, as focal point 1, and the window, as beryllium window 52. The geometry and positioning of collimator 60 is selected to preclude any of the x-rays emitting from anode target 44 from striking aluminum bushing 46, or any other material within opening 48 which could generate secondary sources of radiation, which would then pass through beryllium window 52 and aperture 56, causing shadow anomalies on the x-ray film image.

Figure 5:
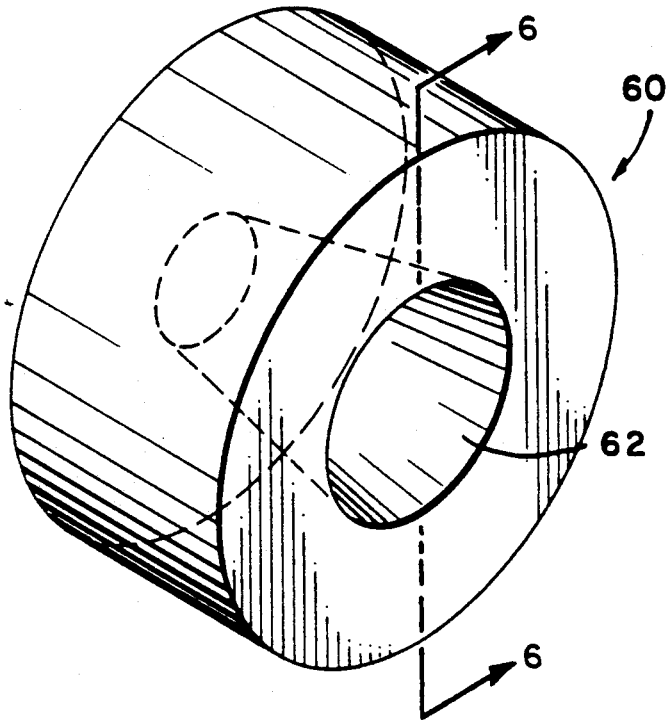
FIG. 5 is a perspective view of the internal collimator illustrated in FIG. 4.
Figure 6:
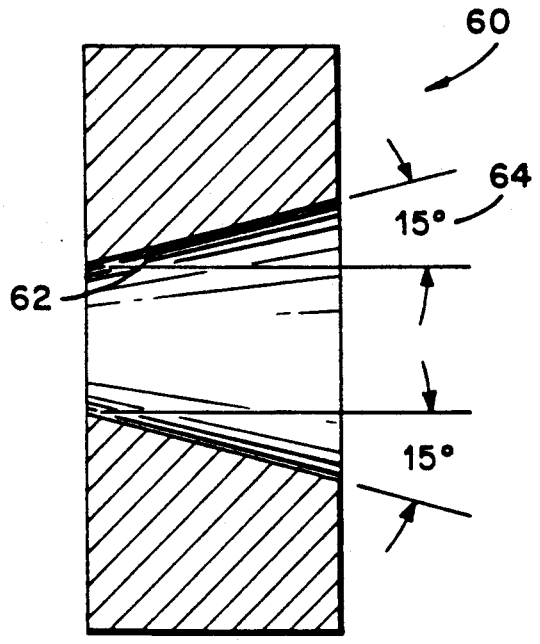
FIG. 6 is a cross sectional view of the internal collimator illustrated in FIG. 5.

Collimator 60, shown also in FIGS. 5 and 6, is preferably formed from tungsten, but can be formed from any material having an atomic number, according to the periodic table of the elements, higher than the atomic number of the elements in the housing which are exposed to the radiation emitted by anode target 44. For example, bushing 46 is typically formed from aluminum, anode body 42 is typically formed from brass. Thus, the collimator is preferably formed from a material having a higher atomic number than those of aluminum and the elements included in the brass. The term "a material having an atomic number", as used herein with reference to the internal collimator, is intended to include elemental materials, alloys, composites, etc. wherein all of the component elements have the required high atomic numbers as described above or are present in amounts resulting in negligible contribution of secondary radiation on exposure to primary radiation in the above-described system.

Although it is intended that the invention disclosed herein include a collimator having a non-tapered aperture, it is much preferred that the aperture be tapered, the maximum angle of taper (from the collimator axis) following closely the maximum angle at which primary radiation will directly strike the x-ray window. Collimator 60, as shown in FIGS. 4–6, includes tapered aperture 62 such that primary x-ray beam 2 passing through aperture 62 of collimator 60 will not strike any material within opening 48 except beryllium window 52 (FIG. 4), and such that x-ray beam 2 passes through the maximum area of beryllium window 52 to provide the maximum "field of view" for exposure of the sample to primary radiation. Taper 64 of aperture 62, as illustrated in FIG. 6, is 15° but can be any taper such that primary x-ray beam 2 passing through collimator 60 will not generate secondary sources of x-rays and yet be sufficient to expose the sample to primary radiation, permitting detection of defects within the sample on x-ray film 6. Various taper configurations are also within the scope of the invention, for example a collimator having a different degree or direction of taper at each end.

Collimator 60, as shown in FIGS. 4–6, typically extends only a short distance into opening 48, and is conveniently a separate component from bushing 46 and is concentric therewith. Alternative arrangements, however, are possible within the scope of the invention. In one alternate embodiment, for example, the internal collimator extends the full length of the bushing; in another, the bushing incorporates the internal collimator; in yet another, the bushing is replaced by an untapered or tapered internal collimator which extends the entire or a partial length of opening 48; and in still another, the collimator may be positioned between the focal point and the bushing, and not necessarily in contact with it.

The collimator aperture, and consequently the path of the primary radiation passing through the aperture, is typically circular in cross-section, but other configurations are within the scope of the invention. Further, the invention is not limited to use with x-ray film, but is effective for improving imaging with any detection system which can be used with the microfocus x-ray system.

The shadow anomaly cannot be explained by the imaging situation alone. In fact, an attempt to explain the shadow by modeling the phenomenon using x-ray attenuation data and a representative imaging geometry led to the discovery of its source. A brief description of that attempt follows.

A representative imaging situation was modeled using x-ray attenuation data for ceramic bars radiographed at a 10× magnification in the above-described IRT Corporation model HOMX 161A microfocus x-ray system. In the imaging geometry shown in FIG. 2, the outer edge of bar 11 presents a shorter x-ray path length than does the main body of the bar. A small change in x-ray path length through the body has a large effect on attenuation for the first few half-value layers, and then attenuation becomes nearly constant in the main body. The term "half value layers", as used herein, is intended to mean that thickness of material which reduces the transmitted x-ray intensity by a factor of 2. The modeled data based on this geometric effect, however, conflicted with the results observed on radiographs obtained using the above-described microfocus x-ray system (without the internal collimator). The width of the principal shadow anomaly was dimensionally greater, by a factor of 3, than that which could be expected based on geometry and x-ray attenuation effects alone. Since the observed experimental results could not be explained considering the imaging physics of the primary x-ray source, it was realized that the most likely cause of the shadow anomaly was extraneous radiation from another source.

In the past, the possibility of a second source of radiation had been considered; however, it was concluded that scattered x-rays, as a second source from the tube head, were not sufficiently intense to produce the observed shadow anomaly. Recent data on attenuation for certain materials being imaged (silicon nitride ceramics) revealed that, for typical film imaging conditions, only 0.3 percent of the primary radiation exposed the film. Therefore, even a weak second source of radiation could contribute a significant amount of exposure to the image, resulting in excess darkening.

An experiment was conducted in which a thin lead sheet (0.005 inches) was placed against the bars (0.125 inches thick) between the bars and the x-ray source. The sheet contour matched that of the bars. Thus, the transmitted primary radiation directed toward the bars was heavily attenuated, but the imaging geometry was not significantly changed. The shadow anomaly remained, confirming the existence of another source of radiation. Contact exposures (images of the tube head made by placing the film directly in front of the tube head) were made of the tube head and x-ray window assembly with high speed instant photography film. The first image revealed that the x-ray window port appeared to be about twice its actual size, indicating that primary radiation from the x-ray focal spot was penetrating the brass tube head housing and aluminum window assembly and producing secondary radiation in the form of re-radiation and/or scatter, effectively producing a second source. The imaging geometry and nominal size of the second source is consistent with the observed shadow anomaly.

Having discovered the cause of the shadow anomaly and defined the origin of the second source of radiation, the solution to the problem could now be addressed. Study of the x-ray tube head revealed that the collimation of the beam in the design of the apparatus was not adequate to suppress extraneous radiation. A series of experiments were conducted by placing collimators made from ⅛ inch thick lead sheet with holes of decreasing diameter outside the window assembly of the above mentioned IRT model HOMX 161, replacing the external collimator provided with the apparatus. A collimator with a 3/16 inch diameter aperture was found to eliminate the shadow anomaly. The compromise was that the field of view (projection) was reduced.

The standard lead collimator, as external collimator 54, that was supplied with the x-ray system is located outside the window assembly, but is ineffective in eliminating secondary radiation because its aperture is too large. For a collimator to be effective in suppressing the shadow anomaly it must limit radiation emanating from the x-ray target toward the sample to only that part of the primary beam directly striking the beryllium window. It was determined that the discovered second source of radiation may be effectively eliminated by positioning a collimator within opening 48 in tube head 42, for example within bushing 46 as shown in FIG. 4, and as close to the x-ray source, as anode target 44, as practicable. Also, by placing the collimator inside the opening and closer to the x-ray focal spot, the radiation from the second source can be minimized without loss of field of view (projection).

A cross-sectional illustration of internal collimator device 60 is shown in FIGS. 4, 5, and 6. Its tapered aperture is designed to limit the primary radiation directed toward the sample to that portion of the beam directly striking x-ray window 52. Since primary rays do not reach the brass tube head and aluminum bushing assembly, these elements are prevented from becoming sources of secondary radiation.

Brass and aluminum have low atomic numbers, and low atomic number elements are known to cause re-radiation and scattering. Tungsten is therefore a preferred internal collimator material because its high atomic number makes it a superior attenuator, and because it has a low vapor-pressure at the temperatures and vacuum environment ($1.2\times10^{-6}$ Torr) experienced within the system. External collimator 54 is typically fabricated from lead, which also has a high atomic number. Thus external collimator 54 will not significantly scatter the primary radiation, and may be removed or may remain in place. The x-ray window used is typically beryllium. This low atomic number element could be a second source of radiation, but its extreme thinness (0.003 inches thick) generates negligible secondary radiation. Experiments comparing beryllium (atomic number 4) and aluminum (atomic number 13) x-ray windows showed that neither material had a discernible effect on the observed shadow anomaly.

Alternate materials, i.e. those made with high atomic number elements consistent with the tube head environment, may be used to fashion the collimator. Also, as described above, the size and shape of the collimator may be changed without significantly varying from the concept.

The x-ray collimating device described herein suppresses second source radiation in microfocus projection radiography systems, effectively eliminating shadow anomalies observed in microfocus projection radiographs. The device significantly improves flaw detection sensitivity in nondestructive evaluation of materials and components by reducing the contribution of unwanted image noise. Thus, the device significantly increases the signal to noise ratio of the image-forming radiation and permits unambiguous interpretation of microfocus projection radiographs cf the materials and components.

While there has been shown and described what are at present considered the preferred embodiments of the invention, it will be obvious to those skilled in the art that various changes and modifications can be made therein without departing from the scope of the invention as defined by the appended claims.

We claim:

1. An improved microfocus projection radiography system comprising:

a body defining an opening through which primary radiation may pass from a focal spot x-ray source toward a sample, wherein said passing primary radiation generally defines a path having a centerline, and said opening has a near end and a distal end relative to said x-ray source;

a window covering said opening at said distal end, wherein said window is penetrable by said passing primary radiation with negligible generation of secondary radiation;

x-ray detection means disposed in said path beyond said sample and generally normal to said centerline so that portions of said passing primary radiation reach both said sample and said detection means to form a projected x-ray image of said sample at said detection means, wherein said sample is spaced from said window and from said detection means to permit magnification of said image; and a collimator defining an aperture and disposed along said path between said focal spot and said window so as to attenuate any of said passing primary radiation not directly striking said window, wherein said collimator is formed from a material having a low vapor pressure at temperatures and pressures at which said system is operated, and portions of said collimator exposed to said passing primary radiation are formed from a material selected to attenuate any of said passing primary radiation not directly striking said window and which generates negligible secondary radiation on exposure to said primary radiation.

2. An x-ray collimating device in accordance with claim 1 wherein said collimator is disposed at least partially within said opening.

3. An x-ray collimating device in accordance with claim 1 wherein said collimator extends within said opening from said near end to said distal end.

4. An x-ray collimating device for use in a microfocus projection radiography system to eliminate shadow anomalies caused by secondary radiation generated upon exposure to primary radiation of materials along a path of said primary radiation, said microfocus projection radiography system comprising: a body defining an opening through which said primary radiation may pass from a focal spot x-ray source toward a sample along said path having a centerline, wherein said opening has a near end and a distal end relative to said x-ray source; a window covering said opening at said distal end, wherein said window is penetrable by said passing primary radiation with negligible generation of secondary radiation; and x-ray detection means disposed in said path beyond said sample and generally normal to said centerline so that portions of said passing primary radiation reach both said sample and said detection means to form a projected x-ray image of said sample at said detection means, wherein said sample is spaced from said window and from said detection means to permit magnification of said image; and said collimating device comprising:

a collimator defining an aperture and positionable along said path between said focal spot and said window so as to attenuate any of said passing primary radiation not directly striking said window, wherein said collimator is formed from a material having a low vapor pressure at temperatures and pressures at which said system is operated, and portions of said collimator exposed in use to said passing primary radiation are formed from e material selected to attenuate any of said passing primary radiation not directly striking said window end which generates negligible secondary radiation or exposure to said primary radiation.

5. An x-ray collimating device in accordance with claim 4 wherein said collimator material consists essentially of tungsten.

6. An x-ray collimating device in accordance with claim 4 wherein said collimator material has an atomic number greater than 15.

7. An x-ray collimating device in accordance with claim 4 wherein said aperture is tapered outwardly away from said x-ray source.

8. An x-ray collimating device in accordance with claim 7 wherein said aperture is tapered at about a 15° angle.

9. An x-ray collimating device in accordance with claim 4 wherein said vapor pressure is below that of lead at said temperatures and pressures at which said system is operated.

10. An x-ray collimating device in accordance with claim 4 wherein said aperture of said collimator at any point along its length is circular and is of a diameter equal to or less than a maximum cross-sectional diameter at that point of a portion of said passing primary radiation which will directly strike said window.

11. An x-ray collimating device in accordance with claim 10 wherein said aperture of said collimator at any point along its length is circular and is of a diameter equal to or less than a maximum cross-sectional diameter at that point of a portion of said passing primary radiation which will directly strike said window.

12. A method for eliminating the shadow anomaly from microfocus projection radiographs caused by secondary radiation generated upon exposure to primary radiation of materials along a path of said primary radiation through a microfocus projection radiography system, wherein said system comprises: a body defining an opening through which said primary radiation may pass from a focal spot x-ray source toward a sample along said path having a centerline, wherein said opening has a near end and a distal end relative to said x-ray source; a window covering said opening at said distal end, wherein said window is penetrable by said passing primary radiation with negligible generation of secondary radiation; and x-ray detection means disposed in said path beyond said sample and generally normal to said centerline so that portions of said passing primary radiation reach both said sample and said detection means to form a projected x-ray image of said sample at said detection means, wherein said sample is spaced from said window and from said detection means to permit magnification of said image; said method comprising the step of:

positioning a collimator defining an aperture along said path between said focal spot and said window so as to attenuate any of said passing primary radiation not directly striking said window, wherein said collimator is formed from a material having a low vapor pressure at temperatures and pressures at which said system is operated, and portions of said collimator exposed in use to said passing primary radiation are formed from a material selected to attenuate any of said passing primary radiation not directly striking said window and which generates negligible secondary radiation on exposure to said primary radiation.

* * * * *